US005218261A

United States Patent [19]

Stark

[11] Patent Number: 5,218,261

[45] Date of Patent: Jun. 8, 1993

[54] SINGLE BASED ELECTRIC LAMP

[75] Inventor: Roland Stark, Wellheim, Fed. Rep. of Germany

[73] Assignee: Patent-Treuhand-Gesellschaft F. Elektrische Gluehlampen mbH, Munich, Fed. Rep. of Germany

[21] Appl. No.: 823,310

[22] Filed: Jan. 21, 1992

[30] Foreign Application Priority Data

Feb. 8, 1991 [DE] Fed. Rep. of Germany ..... 9101460

[51] Int. Cl.[5] ..... H01J 61/34; H01J 6/36; H01K 1/34; H01K 1/46

[52] U.S. Cl. ..... 313/25; 313/318; 313/579

[58] Field of Search ..... 313/25, 318, 579

[56] References Cited

U.S. PATENT DOCUMENTS

| | | | |
|---|---|---|---|
| 3,243,634 | 3/1966 | Mosby | 313/579 X |
| 4,500,948 | 2/1985 | Blaisdell et al. . | |
| 4,687,963 | 8/1987 | Gagnon et al. | 313/579 X |
| 4,743,803 | 5/1987 | Lanese et al. | 313/25 X |

FOREIGN PATENT DOCUMENTS 0200199 11/1986 European Pat. Off. .

*Primary Examiner*—Palmer C. Demeo

*Attorney, Agent, or Firm*—Frishauf, Holtz, Goodman & Woodward

[57] ABSTRACT

To reliably secure a sealed light source bulb element (1*a*), for example a halogen incandescent lamp, to a standard screw-in base, for example an Edison E14 base, while surrounding the sealed bulb element (1*a*) with an outer bulb, a support carrier (8, 8'), for example of nickel-plated steel wire, is bent into essentially ring shape and seated on a ring seating surface (9) formed on a base sleeve which carries the Edison thread. The outer bulb (2) is formed with an extending neck (2*a*) cemented into a cylindrical extension from the base, leaving a small gap from the seating surface to define a groove within which the ring-shaped portion of the support carrier is located. The support carrier ends in a bent-away portion, bent out of the major plane of the ring-shaped portion of the support carrier, into engaging position with one (5) of two current supply leads (4, 5) which extend from the sealed light source bulb element, and is spot-welded to that lead. The support carrier can be secured to the base by soldering, brazing or the like, or, in the alternative, may be formed with an extended spiral portion fitted into the internal thread formed by the internally projecting threads formed by the screw-in base.

12 Claims, 4 Drawing Sheets

SINGLE BASED ELECTRIC LAMP

REFERENCE TO RELATED PATENT LITERATURE

U.S. Pat. No. 4,500,948, Blaisdell et al;
European Published Application 0 200 199, Haraden.

FIELD OF THE INVENTION

The present invention relates to a single-based electric lamp in which an enclosed light source, for example a halogen incandescent lamp, is retained within an outer enclosing bulb to provide, overall, an electric lamp having the advantages of a halogen electric lamp with the overall shape of a standard service light bulb, capable of being directly screwed into a standard lamp socket.

BACKGROUND

Various types of lamps in which a high-intensity light source is retained within an outer enclosing bulb are known, see, for example, the referenced European Patent Disclosure Document 0 200 199, Haraden. In this disclosure, a light source capsule is mounted within an outer envelope by a comparatively complex frame. U.S. Pat. No. 4,500,948, Blaisdell et al, discloses a different type of frame for a similar lamp structure. Such lamps can be used in light fixtures suspended from the ceiling, in table illumination, general store illumination, living spaces, and the like. They are suitable, basically, for general service use.

The light sources may be halogen incandescent lamp elements retained within an outer bulb or vessel. In order to eliminate the expensive flare mounts, a unitary metallic frame has been used to retain a halogen incandescent element within the light bulb as such. The frames, as known in the prior art, are comparatively complex and are constructed so as to prevent transfer of torsional forces to the actual light emitting element. Stop means are provided in the light bulb elements at the outer bulb in the form of notches or the like into which legs or projections of the lamp carrier can engage. They were provided to facilitate screwing of the lamp into a socket when a user grasps the outer bulb. The outer bulb required a neck portion of increased wall thickness in order to permit placement of the notches and the screw thread at its outer wall. This increases the manufacturing costs of the outer bulb and of the lamp carrier, that is, of the overall lamp to be provided to the consumer.

THE INVENTION

It is an object to provide a single-ended lamp having an enclosed light source within an outer envelope which can be inexpensively manufactured and uses a simple arrangement to retain the inner light source within the outer bulb.

Briefly, the bulb has an open end which fits into an essentially cylindrical extension of a metallic base sleeve. The extension projects from a standard Edison screw thread, or equivalent attachment arrangement for fitting into a light socket. The cylindrical extension is slightly wider than the upper end of the screw threaded to form a seating ring. When fitting the open end or neck portion of the outer bulb against the ring, and leaving a little clearance, a groove will be formed within which a support carrier can be placed. The support carrier has an at least part-circular portion, fitted in this thus formed groove, and a bent-away portion extending into the outer bulb and into a position at which it engages and is attached to one of the current supply leads extending from the light source. The essentially ring-shaped support carrier, thus, can be securely retained within the groove and, at the same time, readily support the light source. The ring-shaped element can extend even further, for example in a spiral extension, and fitting within the inner spiral formed by the connecting thread at the outside of the Edison base. It has been found, surprisingly, that the simple shape of the carrier element—essentially only a circular element with a projecting prong—provides for reliable holding of the light source within the outer bulb.

The carrier element is simple, and is readily securely retained within the groove formed, preferably, by the offset ring in the base sleeve in the vicinity of the rim of the outer bulb neck. The outer bulb neck is secured in the base sleeve by cement, as well known. Additional stop arrangements for the lamp carriers, which require special shapes of the outer bulb, thus can be eliminated.

In accordance with a preferred feature of the invention, the carrier is so formed that it clamps against the inner wall of the base sleeve, to ensure a reliable tight seat within the base sleeve, without play. Rotary forces can easily be prevented by providing a metal-to-metal bond between the ring-shaped support carrier and the base sleeve, for example by soldering, brazing, or welding.

If the base sleeve carries a thread, for example the standard screw thread for a lamp, in which the base sleeve thread is deformed from a thin metallic sleeve so that the thread will appear both at the outside as well as at the inside of the sleeve, the carrier element can be extended in a spiral extension to be screwed within the inner portion of the thread. This can eliminate soldering, while ensuring a tight reliable seat of the carrier element within the base as well as making an excellent electrical connection.

DRAWINGS

DETAILED DESCRIPTION

Figure 1:
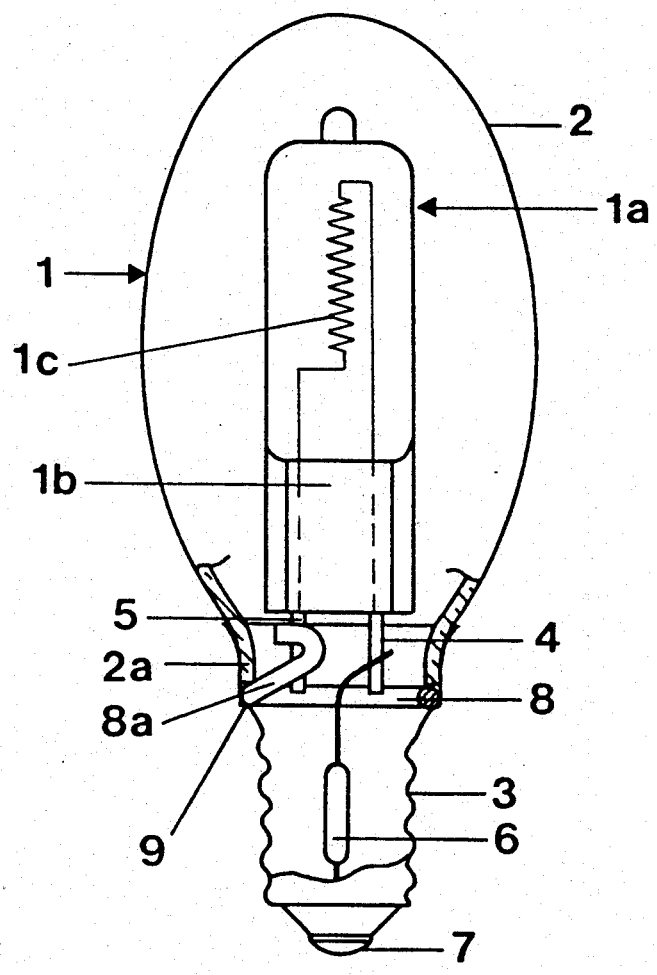
FIG. 1 is a highly schematic side view of a lamp in accordance with the present invention, in which standard elements are shown only schematically.
Figure 2:
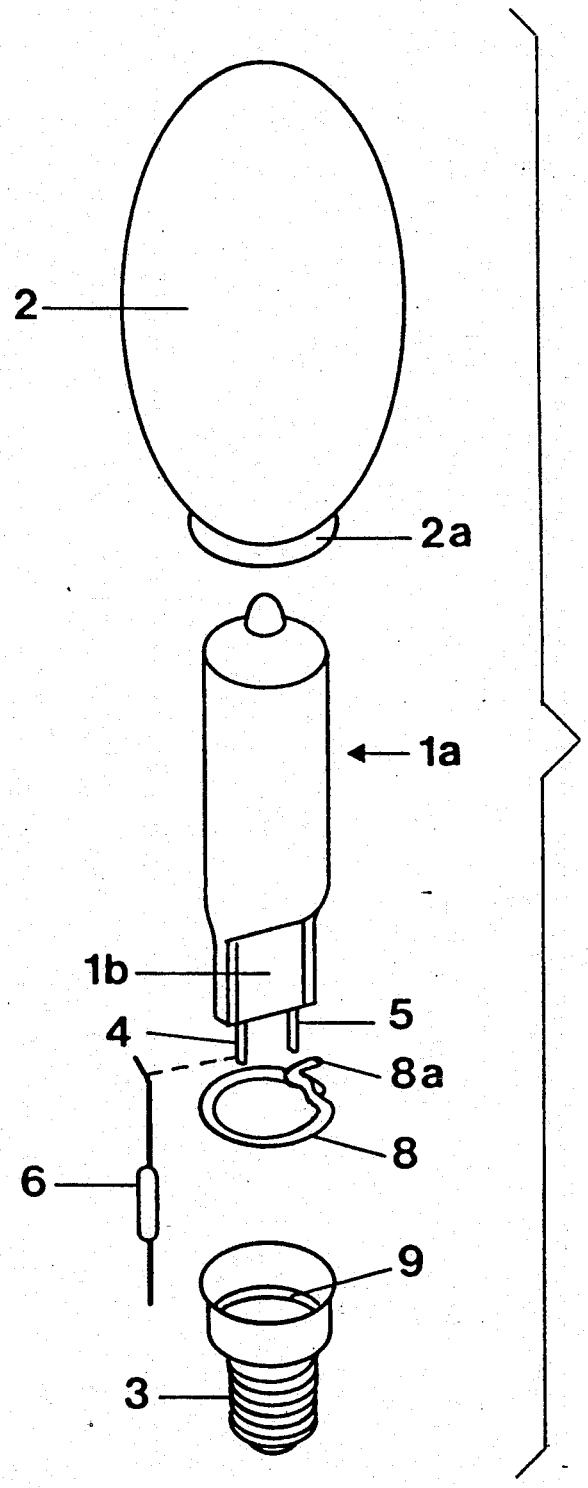
FIG. 2 is an exploded view of the arrangement of FIG. 1, omitting all elements not necessary for an understanding of the present invention.

Referring first to FIGS. 1 and 2:

The lamp 1 has a high-voltage halogen incandescent light emitting lamp element 1*a*, with a bulb of quartz glass, located within a light transmissive outer bulb 2. The light emitting element 1*a* has a pin or press seal 1*b* of standard and well known construction. The light source itself can be conventional and is shown, as an example, as a filament 1*c*.

The outer bulb 2 terminates in a neck region 2*a*, which is held in a metallic base 3 by a suitable cement, as well known. Two current supply leads 4, 5 extend through the pinch seal 1*b* of the light emitting element 1a, to provide electrical energy to the light emitting element.

In accordance with a feature of the invention, the light emitting element 1a is retained within the bulb 2 by a support or carrier element 8. The support or carrier element 8 is seated in a ring-shaped groove on a ring-shaped seat 9 formed on the sleeve 3. The element 8 is soldered to the sleeve 3.

The carrier element 8 is made of nickel-plated steel wire of about 1.5 millimeter diameter. The support carrier 8 has an end portion 8a, bent away from the plane defined by the circular portion of the support carrier. This end element, bent towards the current supply lead 5, is welded, for example by dual spot welding, with the current supply lead 5, to form an electrical connection and, at the same time, a mechanical support for the halogen incandescent element 1a. The circular diameter of the support carrier 8, before insertion into the sleeve, is slightly larger than the inner diameter of the sleeve 3, so that it will be resiliently retained within the sleeve 3, in a stressed, clamped condition. The ring-shaped groove to receive the support carrier is formed by the end rim or edge of the neck portion 2a of the outer bulb 2, and by the offset or seat 9 of the sleeve 3. The support element 8, then, seats in this so formed groove and on the offset 9. The dimensions of the groove are matched to fit the corresponding dimensions of the support element 8.

The support element 8 ensures not only reliable retention and support of the halogen incandescent lamp 1a, but also provides for electrical contact between the current supply lead 5 and the base sleeve 3. The base sleeve 3 is formed with a thread to match a suitable socket, for example an E14 thread.

The current supply lead 4 is electrically connected to the tip or terminal contact 7 of the base through a fuse 6, welded in the connecting lead between the terminal contact 7 and the externally projecting current supply lead 4.

Figure 3:
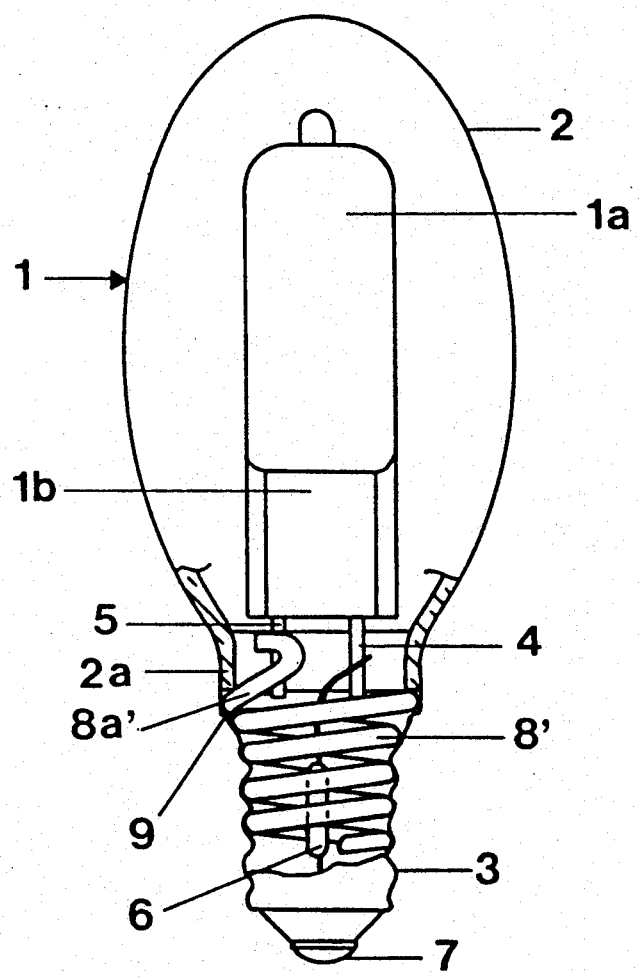
FIG. 3 is a view similar to FIG. 1, and illustrating another embodiment, in which the base sleeve is partly broken away.
Figure 4:
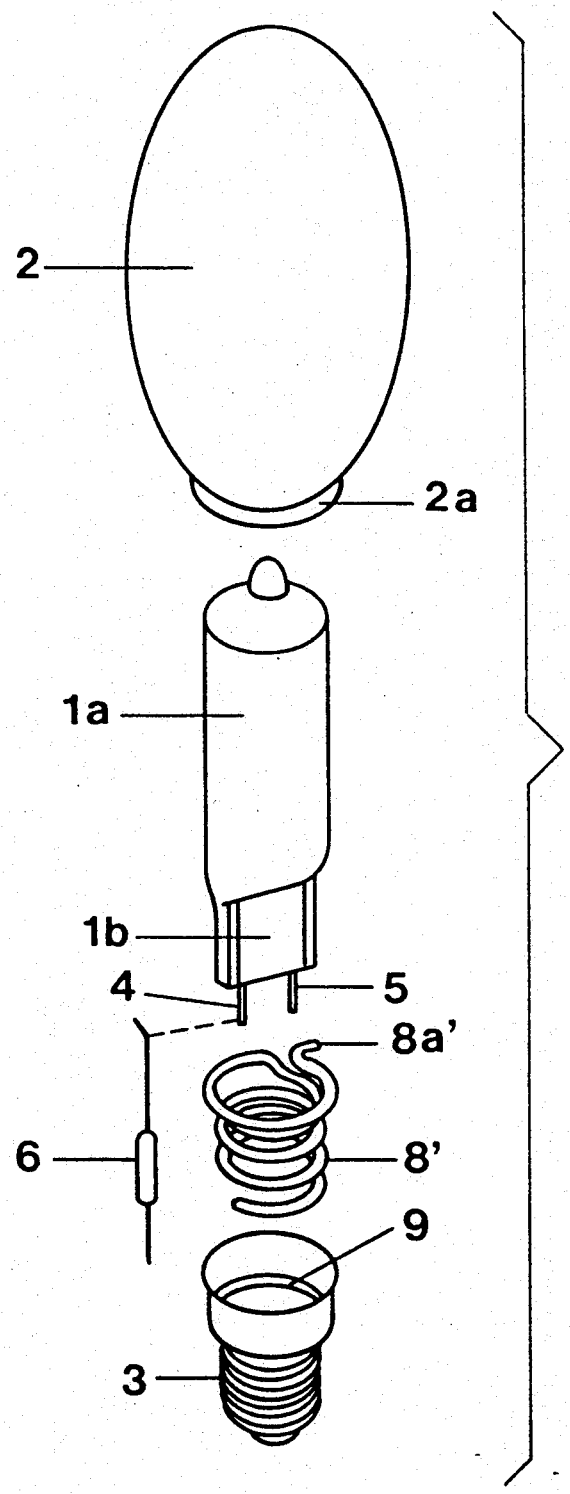
FIG. 4 is an exploded view of the arrangement of FIG. 3.

FIGS. 3 and 4 illustrate a lamp in accordance with another embodiment which differs from that of the just described embodiment only by the shape of the support carrier 8. The support carrier 8', as seen in FIGS. 3 and 4, is formed of a nickel-plated steel wire. The diameter is about 1.5 mm. The support carrier 8' in the second embodiment, is extended to form a spirally extending portion having a plurality of loops or turns, in which the pitch of the spiral corresponds to the pitch of the E14 thread of the base sleeve 3.

The final turn of the support carrier 8' has an enlarged diameter and is fitted into a ring-shaped groove which, as in the embodiment of FIGS. 1 and 2, is formed by a gap between the neck portion 2a of the outer bulb and a ring-shaped seat or offset 9 of the base sleeve 3. A bent-over end portion 8a, extending in interfering position with respect to one of the current supply leads from the halogen incandescent lamp, as seen at 8a', projects towards the interior of the bulb; the current supply lead 5 is welded to this extended end piece 8a', for example by double point spot welding.

Assembly of the Lamp

After welding the end element 8a' to the current supply lead 5, the support carrier 8' together with the halogen incandescent lamp, is screwed into the interior of the base sleeve 3 until the last winding of the support carrier 8' seats on the ring seat 9 of the base sleeve 3. The individual windings or turns of the support carrier 8' are formed to be slightly larger, that is, with a slightly greater diameter than the interior diameter of the base sleeve 3. The support carrier 8' thus is stressed as it engages the inner wall of the base sleeve 3. The extended contact between the support carrier 8' and the base sleeve 3 provides a tight, secure stressed friction seat which, then, does not require metal or metallic bonding. Thus, soldering or brazing the support carrier 8' to the base sleeve 3 will no longer be necessary.

Various changes and modifications may be made; the invention is applicable to all kinds of bases, and not only to the bases of the E14 screw-in type; other light sources than halogen incandescent lamps may be used.

I claim:

1. A single-based electric lamp (1) having
a sealed light source bulb element (1a);
light emitting means (1c) within the bulb element;
two current supply leads (4, 5) extending from the sealed light source bulb element (1a) to supply electrical power to the light emitting means (1c);
a light transparent outer bulb (2) having an open end and including a neck portion (2a) formed thereon;
an at least part essentially cylindrical metallic base sleeve (3) secured to the neck portion (2a) of the outer bulb (2); and
a support carrier (8, 8') for supporting the sealed light source bulb element (1a) within the outer bulb,
wherein
the metallic base sleeve (3) is formed with a ring seat (9);
said support carrier (8, 8') comprises an at least part-circular portion located on said ring seat (9);
a bent-away portion (8a, 8a') extending toward the outer bulb and into an engagement position with one (5) of the current supply leads when the light source bulb element is positioned within the outer bulb (2); and
a weld connection between said one current supply lead (5) and the bent-away portion for mechanical support of the sealed light source bulb element (1a) within the outer bulb and electrical connection of said one current supply lead (5) to the base sleeve (3).

2. The lamp of claim 1, wherein said metallic base sleeve (3) is formed with a socket engagement portion and an essentially cylindrical terminal portion extending opposite said socket engagement portion from said seat (9) and having a diameter larger than said socket engaging portion, whereby said seat will form a seating surface;
said neck portion (2a) of the outer bulb (2) being fitted into said terminal portion and cemented therein, the outer rim of said neck portion being spaced from said seating surface to form a groove; and
wherein said at least part-circular portion of the support carrier is positioned in said groove.

3. The lamp of claim 2, wherein said at least part-circular portion of the support carrier, when removed from said lamp, has a diameter slightly larger than the diameter of said at least part essentially cylindrical metallic base sleeve, whereby, upon insertion of said larger portion into said base sleeve, said at least part-circular portion can resiliently press and frictionally engage the base sleeve and said seating surface (9).

4. The lamp of claim 3, wherein said support carrier (8, 8') comprises a wire metal element.

5. The lamp of claim 1, wherein said support carrier (8, 8') comprises a wire metal element, and said at least part-circular portion thereof is secured to said base sleeve (3) by a metal-to-metal bond, optionally by soldering or brazing or welding.

6. The lamp of claim 1, wherein said support carrier (8, 8') comprises a steel wire, bent to form a part-circular ring; and wherein said bent-away portion extends from a plane defined by said at least part-circular ring.

7. The lamp of claim 6, wherein said steel wire is a nickel-plated steel wire having a diameter of approximately 1.5 mm.

8. The lamp of claim 1, wherein said base (3) has an internal thread; and wherein said support carrier comprises a steel wire bent into a spiral, screw-like configuration defining spiral turns, and having a screw pitch which matches the screw pitch of the internal thread of the base (3).

9. The lamp of claim 8, wherein the support carrier (8'), before being fitted into said base, has a diameter which is slightly larger than the diameter of the base, and the spiral turns have diameters which are larger than the internal diameter of the spiral thread of the base, to permit, upon insertion of the support carrier and screwing the support carrier into the base, resilient compression of the support wire and stressed, frictional engagement of the support wire with said base; and wherein said at least part-circular portion of the support wire is seated on said surface.

10. The lamp of claim 7, wherein said support carrier is a nickel-plated steel wire having a diameter of approximately 1.5 mm.

11. The lamp of claim 1, wherein said at least part-circular portion of the support carrier, when removed from said lamp, has a diameter slightly larger than the diameter of said at least part essentially cylindrical metallic base sleeve, whereby, upon insertion of said larger portion into said base sleeve, said at least part-circular portion can resiliently press and frictionally engage the base sleeve and said seating surface (9).

12. The lamp of claim 1, wherein the light source bulb element comprises a halogen incandescent lamp (1*a*) formed with a pinch or press seal (1*b*) from which said current supply leads (4, 5) extend.

* * * * *

UNITED STATES PATENT AND TRADEMARK OFFICE

CERTIFICATE OF CORRECTION

PATENT NO. : 5,218,261

DATED : June 8, 1993

INVENTOR(S) : STARK, Roland

It is certified that error appears in the above-indentified patent and that said Letters Patent is hereby corrected as shown below:

Column 6, line 8 (claim 10), change "claim 7" to --claim 9--.

Signed and Sealed this

Fourteenth Day of June, 1994

Bruce Lehman

*Attest:*

BRUCE LEHMAN

*Attesting Officer*

*Commissioner of Patents and Trademarks*